United States Patent [19]

Petzold

[11] 4,015,831

[45] Apr. 5, 1977

[54] ARRANGEMENT FOR GALVANIZATION AND CHEMICAL TREATMENT OF ARTICLES

[75] Inventor: Wolfgang Petzold, Stuttgart, Germany

[73] Assignee: Schering Aktiengesellschaft, Berlin and Bergkamen, Germany

[22] Filed: Sept. 20, 1974

[21] Appl. No.: 507,951

[30] Foreign Application Priority Data

Dec. 8, 1973 Germany ..... 2361683

[52] U.S. Cl. ..... 259/81 R; 204/213

[51] Int. Cl.[2] ..... B01F 9/00; C25D 17/00

[58] Field of Search ..... 259/81 R, 89, 90; 204/213, 214

[56] References Cited

UNITED STATES PATENTS

| | | | |
|---|---|---|---|
| 2,212,560 | 8/1940 | Foley | 259/90 |
| 3,008,893 | 11/1961 | Belke et al. | 259/81 R |
| 3,153,624 | 10/1964 | Jackson | 204/213 |
| 3,563,877 | 2/1971 | Carmichael | 259/89 |

FOREIGN PATENTS OR APPLICATIONS

| | | | |
|---|---|---|---|
| 705,269 | 2/1936 | Germany | 204/213 |
| 882,937 | 3/1942 | Germany | 204/213 |
| 813,915 | 9/1951 | Germany | 259/81 R |

*Primary Examiner*—Harvey C. Hornsby
*Assistant Examiner*—Robert Pous
*Attorney, Agent, or Firm*—Joseph F. Padlon

[57] ABSTRACT

An arrangement for the chemical treatment or galvanizing of articles or bulk materials in which the articles to be treated or processed are made of metal, plastics or other materials, and are held within a drum. The wall of the drum is provided with distributed openings or perforations having a conical shape in an alternating manner.

7 Claims, 5 Drawing Figures

ARRANGEMENT FOR GALVANIZATION AND CHEMICAL TREATMENT OF ARTICLES

BACKGROUND OF THE INVENTION

The present invention relates to a drum used for galvanization or chemical processing or treatment of articles or bulk parts which are made of metal, plastics, or other raw materials.

Drums of the preceding species, are already known in the art, and such conventional drums have a variety of different designs. It has, however, been found that the manner of perforation of the covering surface or drum, as well as their inner surface structure influenced considerably the galvanization process. Thus, it has been found that the manner of perforation regulates extensively the current consumption of the galvanization or plating material within the drum. In a predetermined drum construction having walls 8 mm, the voltage dropped in a cyanide-zinc electrolyte having a conductance of 260 mS is 0.2 volts for an opening diameter of 6 mm. This voltage drop rises to 0.3 volts when the opening diameter is substantially 4 mm. When the perforation or opening diameter is substantially 2 mm, the voltage drop rises to 1.0 volts, and increases to 3.0 volts when the opening or perforation diameter is 1 mm.

The voltage drop is, furthermore linearly dependent upon the length of the cylindrical openings or perforations, and consequently upon the thickness of the wall or covering of the casing. In order to achieve substantially negligible voltage drop and therefore high current consumption, it is essential to select perforations or openings having a maximum diameter, and to locate such perforations side-by-side as close as possible. The size and shape of the parts are essential from the viewpoint of the diameter of the perforations or holes, since these parts may slip through the openings or holes or adhere to the internal walls of the perforations, when the diameters are made too large. The density or close spacing of the perforations, on the other hand, is determined by the static strength of the material from which the drum casing is fabricated.

The surface condition of the internal casing is of importance, particularly from the viewpoint of flat parts. To avoid the adherence of flat parts to the interior surface of the drum, this interior surface is fabricated of uneven or irregular shape, in different ways, in accordance with the present state of the art. Thus, the interior surface is either serrated, or perforations are partially sunk into the surface. Such resultant serrations or perforations on the interior surface, require a predetermined spacing so as to form the desired irregularity or unevenness of the inner surface of the drum. Thus, a predetermined and sufficient spacing of the perforations from opening to opening is necessary in order to achieve the desired irregularity.

It is, however, not possible to increase the current consumption of such galvanization or plating drums, due to the limitations imposed by the static structural requirements associated with the irregular or uneven interior surface caused by the serrations or perforations. Thus, whereas it would be desirable to increase the current consumption with such drums, it is not possible to do so because the spacing of the perforations are a limiting factor.

For the purpose of avoiding the disadvantages enumerated above, it was proposed to use a screen-like synthetic fabric for gauze material for the drum casing.

However, drums fabricated of such screen-like casing are suitable only for treating light-weight parts, since the fabric or similar material is easily destroyed during use and operation. Thus, parts made of plastics, for example, can only be processed in the drum, when of substantially small dimensions.

In another proposed arrangement, it was suggested that the drum wall has inserted into it, so-called sieve plugs. Such a design corresponds to injection-molded or pressed plastics plugs provided with a sieve-shaped perforation. With prolonged usage, such plugs could then be readily exchanged, after having become worn out. The disadvantage of the preceding design, however, is mainly the comparatively rapid erosion of the sieve plugs, rather than the gaps prevailing between the individual sieve plugs, and which cannot be perforated.

Accordingly, it is an object of the present invention to avoid the disadvantages enumerated above, by providing a drum with maximum perforation density of the casing surface.

It is another object of the present invention to provide a drum arrangement of the foregoing character, which may be simply fabricated and economically maintained.

SUMMARY OF THE INVENTION

The objects of the present invention are achieved by providing a drum in which perforations or openings are alternately conically formed. In a preferred embodiment of the present invention, the perforations or holes are conically shaped and staggered over the entire depth of the drum casing.

In a particularly advantageous arrangement of the present invention, the small and large openings in the drum casing are closely spaced with respect to each other, and border in close proximity.

In a further embodiment of the present invention, the perforations or holes are in the form of an eight-sided frustum of a pyramid or of some conical shape.

When a casing is perforated in this manner, a surprisingly intensive fluid exchange takes place between the inner area or surface of the drive drum, and the electroplating bath in which the drum is immersed. In driving the drum, the alternating conically-shaped perforations intersect at right-angle, the perforation axis with respect to which, the bath fluid moves. As a result of the conical shape, turbulent flow occurs which provides for a particularly intensive fluid exchange.

The drum in accordance with the present invention has, furthermore, the additional advantage that the displacement losses are smaller than those resulting with drums that have cylindrical perforations. This advantage is derived from the condition that the conically oblique or inclined inner surface of the perforations or holes, do not hold fluid as in the case of cylindrically-shaped perforations or holes of substantially small diameters.

A still further advantage of the drum constructed in accordance with the present invention, resides in the feature that the drum is particularly well adapted to the drying process which follows the galvanization or plating process. This advantageous feature derives from the condition that the warm air directed or blown onto the drum, encounters substantially low resistance through the conically-shaped perforations or holes, and can, thereby, easily penetrate the drum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
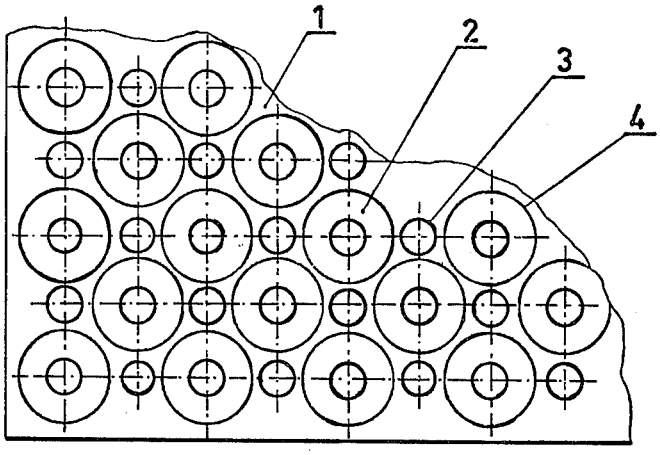
FIG. 1 is a plan view of a part of the drum surface, and shows the arrangement of the perforations or holes, in accordance with the present invention.
Figure 2:
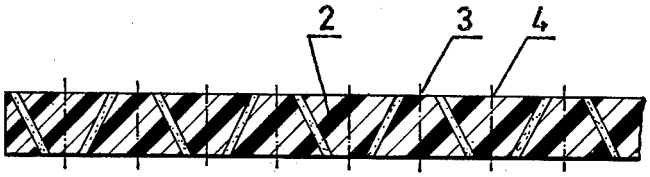
FIG. 2 is a sectional view through the wall of the drum of FIG. 1.

Referring to the drawing and in particular to FIG. 1, the drum wall 1 is provided with alternating conically-shaped perforations or holes 2. These perforations or openings have a small diameter 3 on one side or surface of the drum wall, and a substantially larger diameter 4 on the opposite side of the drum wall or surface. The small diameter 3 is made, thereby so that the parts or articles to be treated within the drum, cannot fall or pass through the holes or perforations. The large diameter 4, and consequently the spacing between perforations or holes, is determined by the strength of the casing or wall 1. At the same time, the degree of the conical shape is also determined by the permissible diameter 4 and spacing between perforations.

Figure 3:
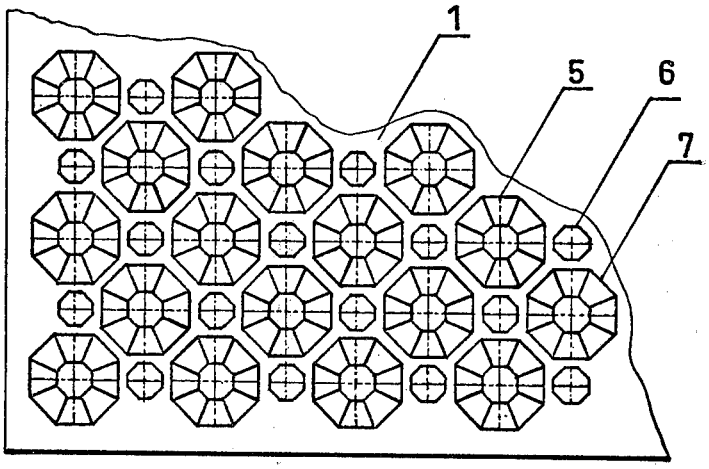
FIG. 3 is a plan view of another embodiment of the perforations shown in FIG. 1.
Figure 4:
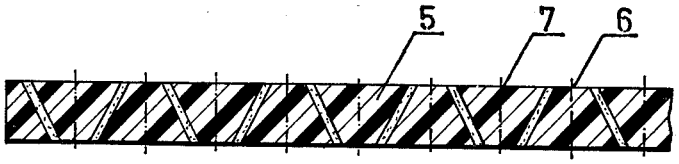
FIG. 4 is a sectional view of the drum wall of the embodiment of FIG. 3.
Figure 5:
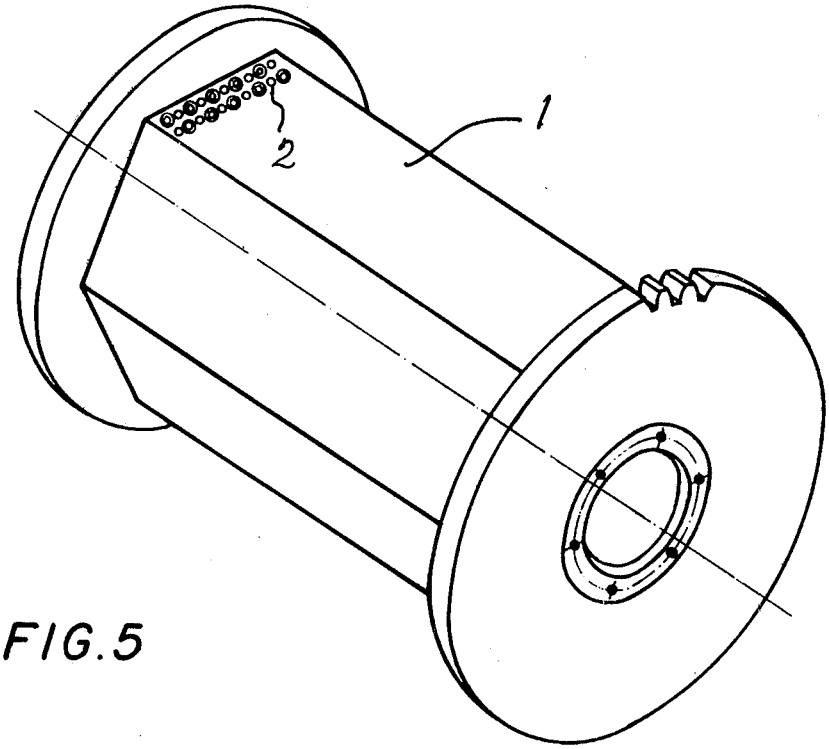
FIG. 5 is a perspective view of the drum in accordance with the present invention.

In another embodiment of the present invention, the conical shaped perforations or openings are replaced by perforations having an eight-sided pyramid. This arrangement is shown in FIG. 3 in which the plan view is illustrated and in FIG. 4 which shows the construction of the perforations when a section is taken through the drum wall. In this embodiment, the casing surface 1 has the same displaced openings or holes, which assume, however, the shape of an eight-sided frustum of a pyramid 5. These perforations are provided, on the one side, with substantially small eight-sided openings 6, and, on the other side, these perforations or openings are provided with substantially large eight-sided openings 7.

The drum wall can be constructed of materials, in accordance with the present invention, which are made of, for example, polyvinylchloride, polyethylene, polypropylene, and similar such materials.

The drum in accordance with the present invention can be used for the plating or chemical treatment of bulk materials or articles which are made of metal, plastics, or other materials.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims:

1. A drum for plating and chemical treatment of articles comprising, a drum wall with distributed openings through said wall, said openings being alternating conically shaped and arranged over the entire drum wall, the cross-section of one opening on the exterior surface of the drum wall being smaller than the cross-section of said one opening on the interior surface of the drum wall, the cross-section of a neighboring opening on the exterior surface of the drum wall being larger than the cross-section of said neighboring opening on the interior surface of the drum wall, so that said drum wall has substantially maximum perforation density.

2. The drum as defined in claim 1 wherein said openings extend the entire depth of the wall of said drum and have a conical shape.

3. The drum as defined in claim 1 wherein said openings are offset with respect to each other.

4. The drum as defined in claim 1 wherein said openings are in substantially close proximity of each other.

5. The drum as defined in claim 1 wherein said openings have the shape of a frustum of an eight-sided pyramid.

6. The drum as defined in claim 1 wherein said openings are substantially conical.

7. The drum as defined in claim 2 wherein said openings are offset with respect to each other, said openings being arranged in substantially close proximity of each other, said openings having the shape of a frustum of an eight-sided pyramid.

* * * * *